US008553915B2

(12) United States Patent
Nishizaki et al.

(10) Patent No.: US 8,553,915 B2
(45) Date of Patent: Oct. 8, 2013

(54) HEARING AID ADJUSTMENT DEVICE, HEARING AID ADJUSTMENT METHOD, AND PROGRAM FOR HEARING AID ADJUSTMENT

(75) Inventors: Makoto Nishizaki, Tokyo (JP); Hiroshi Kondo, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/575,764

(22) PCT Filed: Feb. 6, 2012

(86) PCT No.: PCT/JP2012/000790

§ 371 (c)(1),
(2), (4) Date: Jul. 27, 2012

(87) PCT Pub. No.: WO2012/132189

PCT Pub. Date: Oct. 4, 2012

(65) Prior Publication Data

US 2013/0202123 A1 Aug. 8, 2013

(30) Foreign Application Priority Data

Mar. 31, 2011 (JP) ..... 2011-080507

(51) Int. Cl.
*H04R 25/00* (2006.01)

(52) U.S. Cl.
USPC ..... 381/312; 381/60

(58) Field of Classification Search
USPC ..... 381/60, 312, 314–321
See application file for complete search history.

(56) References Cited

U.S. PATENT DOCUMENTS

| | | | |
|---|---|---|---|
| 8,243,972 | B2 | 8/2012 | Latzel |
| 2004/0066944 | A1 | 4/2004 | Leenen et al. |
| 2009/0180650 | A1 | 7/2009 | Latzel |
| 2012/0070023 | A1 | 3/2012 | Nishizaki |

FOREIGN PATENT DOCUMENTS

| | | |
|---|---|---|
| EP | 2 081 406 | 7/2009 |
| EP | 2 426 953 | 3/2012 |
| JP | 8-317495 | 11/1996 |

(Continued)

OTHER PUBLICATIONS

Supplementary European Search Report issued Nov. 20, 2012 in Application No. EP 12 74 3347.

(Continued)

*Primary Examiner* — Suhan Ni
(74) *Attorney, Agent, or Firm* — Wenderoth, Lind & Ponack, L.L.P.

(57) ABSTRACT

A hearing aid adjustment device (1) has a comparator (22*a*) and a setting section (22*b*). The comparator (22*a*) compares a user evaluation given by a user (T) of a hearing aid (5) in response to sound obtained by hearing aid processing based on fitting theories and hearing level data for the user (T), with a reference evaluation that has been acquired ahead of time and corresponds to each of customers (A to C) and is given by the customers (A to C) in response to sound obtained by hearing aid processing based on fitting theories and hearing level data for the customers (A to C). The setting section (22*b*) sets the value of a user parameter designating hearing aid processing to be given to a user (T), to a value that is the same as the value of a reference parameter that has been acquired ahead of time and that designates hearing aid processing suited to a customer (A) who gave a reference evaluation similar to the user evaluation, out of the customers (A to C).

7 Claims, 9 Drawing Sheets

(56) References Cited

FOREIGN PATENT DOCUMENTS

| | | |
|---|---|---|
| JP | 9-54765 | 2/1997 |
| JP | 2000-125396 | 4/2000 |
| JP | 2001-175637 | 6/2001 |
| JP | 2001-197597 | 7/2001 |
| JP | 2001-204098 | 7/2001 |
| JP | 2003-339760 | 12/2003 |
| WO | 2011/132403 | 10/2011 |

OTHER PUBLICATIONS

International Search Report issued Apr. 3, 2012 in International (PCT) Application No. PCT/JP2012/000790.

Written Opinion of the International Searching Authority issued Apr. 3, 2012 in International (PCT) Application No. PCT/JP2012/000790.

| Customer | Evaluation result | | | | | Hearing level data | Final result (right ear) |
|---|---|---|---|---|---|---|---|
| | Theory | | | | | | |
| | 1 | 2 | 3 | 4 | 5 | | |
| A | N | S | S | N | N |   |   |
| B | G | N | S | G | G |   |   |
| C | S | S | G | S | N |   |   |
| D | N | N | N | G | G |   |   |
| : | : | : | : | : | : | : | : |

N: Not good, S: So-so, G: Good

10

| | Evaluation result | | | | | | Hearing level data | Final result (right ear) |
|---|---|---|---|---|---|---|---|---|
| | Theory | | | | | Score | | |
| | 1 | 2 | 3 | 4 | 5 | | | |
| T (user) | N | S | G | N | N | |  | |
| A (customer) | N | S | S | N | N | 13 |  |  |
| B (customer) | G | N | S | G | G | −1 |  |  |
| C (customer) | S | S | G | S | N | 11 |  |  |

N: Not good, S: So-so, G: Good

10

12

HEARING AID ADJUSTMENT DEVICE, HEARING AID ADJUSTMENT METHOD, AND PROGRAM FOR HEARING AID ADJUSTMENT

TECHNICAL FIELD

The present invention relates to a hearing aid adjustment device, a hearing aid adjustment method, and a program for hearing aid adjustment, all of which are used for adjusting a hearing aid.

BACKGROUND ART

Fitting is typically performed to prepare a hearing aid for use. In this fitting, characteristics related to the hearing aid processing of the hearing aid (hearing aid characteristics) are set to suit the hearing ability of the hearing aid user. That is, first of all, the hearing ability of the user is measured over a range from low to high audible frequencies. Then, the hearing aid characteristics are adjusted on the basis of the hearing level data obtained by this measurement. More specifically, a value is set for hearing aid processing parameters that will determine the hearing aid processing to be executed by the hearing aid.

However, the work of adjusting a hearing aid often ends up taking a long time even for an experienced hearing aid adjuster.

Specifically, our perception of how we hear sounds varies from one person to the next, and this is also greatly affected by the measurement environment (such as the climate and the size of the measurement space), the time of day when the measurement is conducted, the physical condition of the hearing aid user, and so forth. These factors combine to make adjustment a time-consuming process. More specifically, once adjustment has proceeded a certain amount, the hearing aid adjuster gradually decides that the hearing aid processing parameters have been narrowed down to their final values that are suited to the hearing aid user.

Meanwhile, how a user hears sounds will sometimes vary compared to when the adjustment was started, due to external or internal factors. For instance, the user may conclude that a previous test sound was better than the current test sound. Therefore, the adjustment work frequently has to back up and the same work repeated, which tends to result in the adjustment taking a longer time.

In view of this, there have been attempts in the past at utilizing an interactive genetic algorithm (GA) in an effort to find an adjustment value semi-automatically, taking into account such subjective swings in evaluations of hearing (see Patent Literature 1, for example).

CITATION LIST

Patent Literature

Patent Literature 1: Japanese Laid-Open Patent Application 2001-175637

SUMMARY

A conventional method involving a GA makes use of an initial value set of hearing aid processing parameters given randomly over a range in which excessively loud or soft sounds are not outputted. The hearing aid processing parameters included in the initial value set are subjected to a hearing test and evaluation by the hearing aid user, and hearing aid processing parameters with high evaluation marks are extracted. A new hearing aid processing parameter set is produced by using "selection," "intersection," and "mutation," which are the basic GA operations, on the extracted hearing aid processing parameters. Then, the new hearing aid processing parameters are subjected to a hearing test and evaluation by the hearing aid user, and hearing aid processing parameters with high evaluation marks are extracted. The extracted hearing aid processing parameters become the basis for creating the next new hearing aid processing parameters by basic GA operation.

Thus, with a hearing aid adjustment method featuring a GA, a set of hearing aid processing parameters is subjected to a series of operations, namely, a hearing test, evaluation, and GA operation, over and over to find the suboptimal hearing aid processing parameters for a user. In other words, with a hearing aid adjustment method featuring a GA, variance in a hearing aid user's decisions is taken into account to a certain extent, while attempting to narrow down the hearing aid processing parameters that will be the object of the hearing test.

However, if this narrowing down by GA is unsuccessful, the hearing test and evaluation have to be repeated dozens of times, or in some cases hundreds of times, until the adjustment of the hearing aid is finished. As a result, with an adjustment method featuring a GA, adjustment of a hearing aid ends up taking a tremendous amount of time, although the hearing aid processing parameters can be found semi-automatically.

Technical Problem

In light of the above problems, it is an object of the present invention to efficiently find hearing aid processing parameters that reflect how a hearing aid user hears sounds, while reducing the number of times the hearing aid user has to undergo hearing testing and evaluation.

Solution to Problem

The hearing aid adjustment device disclosed herein has a comparator and a setting section.

The comparator compares a first evaluation given by a hearing aid user in response to sound obtained by hearing aid processing based on a specific method and the hearing level data for the user, and a second evaluation acquired ahead of time and corresponding to each of a plurality of reference users, and given by the reference users in response to sound obtained by hearing aid processing based on the specific method and the hearing level data for the reference users. The setting section sets the value of a first parameter designating hearing aid processing to be given to the user, to a value that is the same as the value of a second parameter that is acquired ahead of time and designates hearing aid processing suited to those reference users who gave a second evaluation that matched or was similar to the first evaluation, out of the plurality of reference users.

The hearing aid adjustment method disclosed herein involves acquiring, from a data storage section, second evaluation information expressing a second evaluation given by a plurality of reference users in response to sound that is stored ahead of time in the data storage section and corresponding to each of the reference users and that is obtained by hearing aid processing based on a specific method and hearing level data for the reference users. This hearing aid adjustment method also involves comparing the second evaluation information acquired from the data storage section with first evaluation information expressing a first evaluation given by the user in response to sound obtained by hearing aid processing based on a specific method and hearing level data for the user. This hearing aid adjustment method further involves setting the value of a first parameter designating hearing aid processing to be given to the user, to a value that is the same as the value of a second parameter that has been stored ahead of time in the data storage section and designates hearing aid processing suited to those reference users who gave a second evaluation that matched or was similar to the first evaluation, out of the plurality of reference users.

With this hearing aid adjustment device and hearing aid adjustment method, a hearing aid user and a plurality of reference users evaluate a sound obtained by hearing aid processing based on the same specific method. Here, if a first evaluation given by the user is similar to a second evaluation given by the reference users, it can be concluded that the individual preference of the user as related to hearing aid processing is similar to the individual preferences of the reference users as related to hearing aid processing. Therefore, the value of a first parameter designating the hearing aid processing to be given to a user is set to a value that is the same as the value of a second parameter designating hearing aid processing suited to reference users who gave a second evaluation that matches or is similar to the first evaluation given by the user. As a result, the subjective preferences of the user as related to hearing aid processing are reflected in the first parameter.

Consequently, the subjective preferences of the user as related to hearing aid processing can be reflected in the first parameter merely by having the user evaluate a sound obtained by hearing aid processing based on a specific method and hearing level data for that user. Therefore, there is no need for extra repetition of adjustment of the hearing aid processing parameters in order to find the subjective preferences of the user.

Advantageous Effects

Thus, when a hearing aid is adjusted to suit a hearing aid user, hearing aid processing parameters that reflect how the hearing aid user hears sounds can be found efficiently, while reducing the number of times the hearing aid user has to undergo hearing testing and evaluation.

DESCRIPTION OF EMBODIMENTS

Configuration

The configuration of the hearing aid adjustment device 1 pertaining to this embodiment will be described through reference to the drawings.

In the text that follows, a user for whom related data has been recorded in a customer database 10 (discussed below) will be called a reference user in order to distinguish from a user T (an example of a user) that is having the fitting done.

Figure 1:
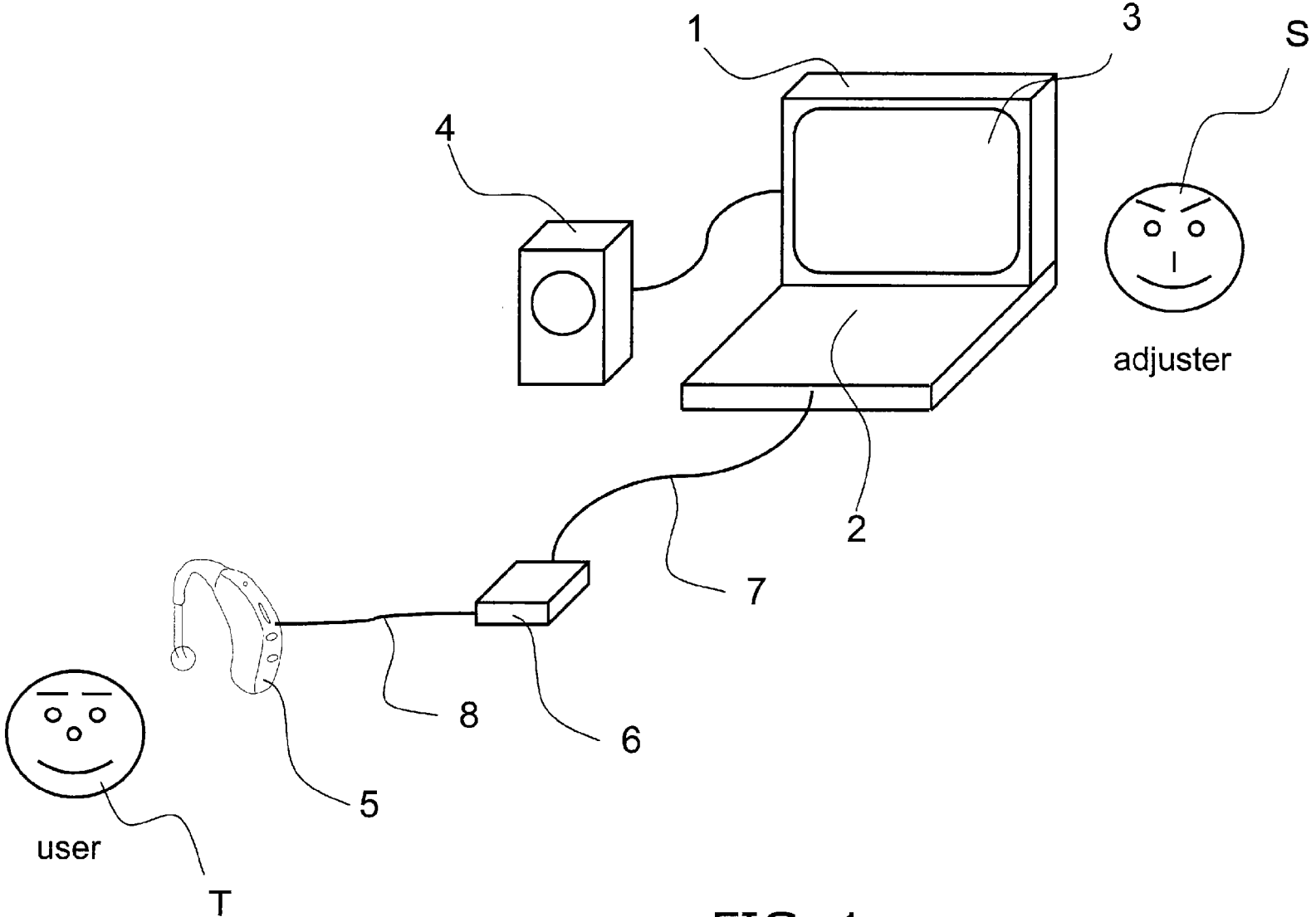
FIG. 1 shows the configuration of a hearing aid adjustment device 1 pertaining to an embodiment of the present invention.

As shown in FIG. 1, the hearing aid adjustment device 1 pertaining to this embodiment comprises an input section 2, a display section 3, and a sound output section 4. This hearing aid adjustment device 1 is connected to a hearing aid 5 via a connection box 6, a wire 7, and a wire 8. The hearing aid 5 is readied separately for the left and right ears of the user T, but in FIG. 1 just one is shown, namely, the one for the right ear.

The input section 2 (an example of an input section) is a keyboard or a mouse, for example, and is operated by an adjuster S. The adjuster S makes changes to the hearing aid processing parameters and so forth by using the input section 2. Adjustment values for the hearing aid processing parameters and so forth inputted by the adjuster S are sent through the connection box 6 and so forth to the hearing aid 5 to set up the hearing aid 5.

The display section 3 is a liquid crystal monitor, for example, and displays information needed to adjust the hearing aid 5.

The sound output section 4 is a speaker, for example, and outputs sounds used to adjust the hearing aid 5.

The hearing aid 5 may be for either the left or right ear. In the description of the embodiment that follows, a hearing aid 5 used for the right ear is given as an example, but adjustment can be performed by the same method as in this embodiment for the hearing aid 5 used for the left ear.

Figure 2:
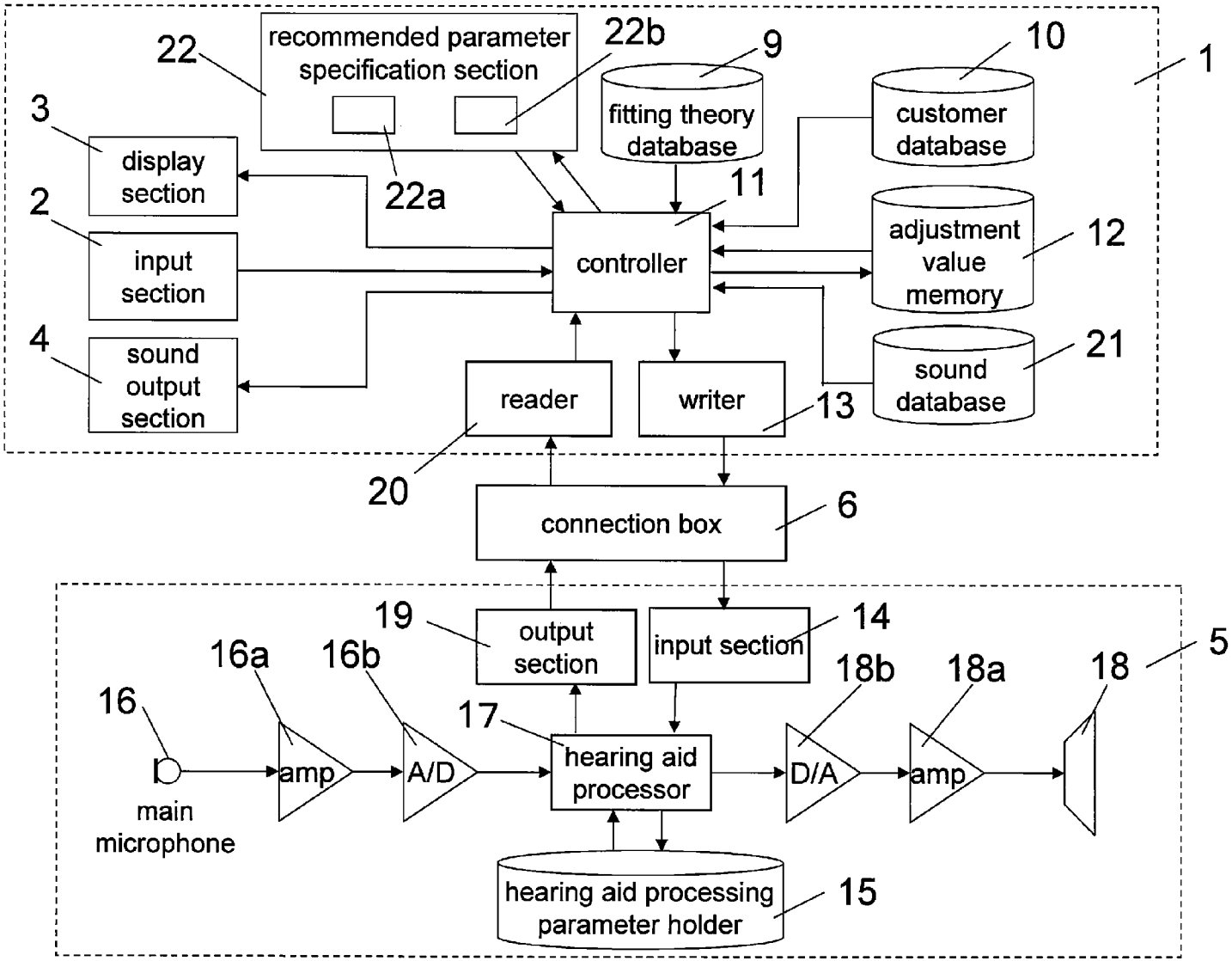
FIG. 2 is a control block diagram of the hearing aid adjustment device 1 in FIG. 1.

FIG. 2 is a control block diagram of the hearing aid adjustment device 1.

The hearing aid adjustment device 1 has a controller 11, an adjustment value memory 12, a sound database 21, a recommended parameter specification section 22, a fitting theory database 9, the customer database 10, a reader 20, and a writer 13.

Each part of the control blocks of the hearing aid adjustment device 1 operates according to adjustment work executed by operation of a slider 37 (see FIG. 6) or the like by the adjuster S.

The controller 11 is a processor, for example, and handles the main processing in the hearing aid adjustment device 1. The controller 11 controls the function of the various functional blocks of the hearing aid adjustment device 1.

The adjustment value memory 12 stores adjustment values for designating hearing aid processing (such as hearing aid processing parameters). The adjustment value memory 12 is a flash memory, for example. When an adjustment value is inputted or changed by the adjuster S through the input section 2, the inputted or changed adjustment value is stored in the adjustment value memory 12 via the controller 11, and displayed on the display section 3.

When a command to write an adjustment value to the hearing aid 5 is inputted by the adjuster S, the adjustment value is written by the display section 3 to a hearing aid processing parameter holder 15 of the hearing aid 5 via the connection box 6 and an input section 14 of the hearing aid 5. The hearing aid processing parameter holder 15 here is used to store hearing aid processing parameters such as gain, compression, and threshold knee point (TK) decided according to the hearing ability of the user T.

The hearing aid 5 has a hearing aid processor 17, the input section 14, the hearing aid processing parameter holder 15, a main microphone 16, a receiver 18, and an output section 19.

The hearing aid 5 uses the hearing aid processor 17 to process sound acquired from the main microphone 16 on the basis of the hearing aid processing parameters stored in the hearing aid processing parameter holder 15, and outputs the result from the receiver 18, thereby providing sound that is suited to the hearing ability of the user T. That is, the hearing aid adjustment device 1 executes hearing aid processing.

The hearing aid 5 here has an amplifier 16*a*, and A/D (analog/digital) converter 16*b*, an amplifier 18*a*, and a D/A (digital/analog) converter 18*b*.

The amplifier 16*a* amplifies the analog sound signal outputted from the main microphone 16. The A/D converter 16*b* converts the analog sound signal outputted from the amplifier 16*a* into a digital sound signal.

The D/A converter 18*b* converts the digital sound signal outputted from the hearing aid processor 17 into an analog sound signal. The amplifier 18*a* amplifies the analog sound signal outputted from the D/A converter 18*b*.

Next, the fitting theory database 9 of the hearing aid adjustment device 1 has a block configuration that is directly related to the hearing aid adjustment method pertaining to this embodiment. The fitting theory database 9 stores a plurality of fitting theories. The fitting theory database 9 is a flash memory, for example.

The term "fitting theory" here refers to a method for calculating hearing aid processing parameters on the basis of hearing level data for the user of the hearing aid 5. That is, a fitting theory is a procedure for information processing based on specific rules, in which the input is the hearing level data for the user of the hearing aid 5, and the output is a hearing aid processing parameter. A fitting theory can also be called an algorithm for calculating hearing aid processing parameters. Therefore, a fitting theory can be a program that is read and executed by a processor or other such computer. In this embodiment, fitting theories are electronically recorded to the fitting theory database 9 as programs that can be read by the controller 11.

Figure 3:
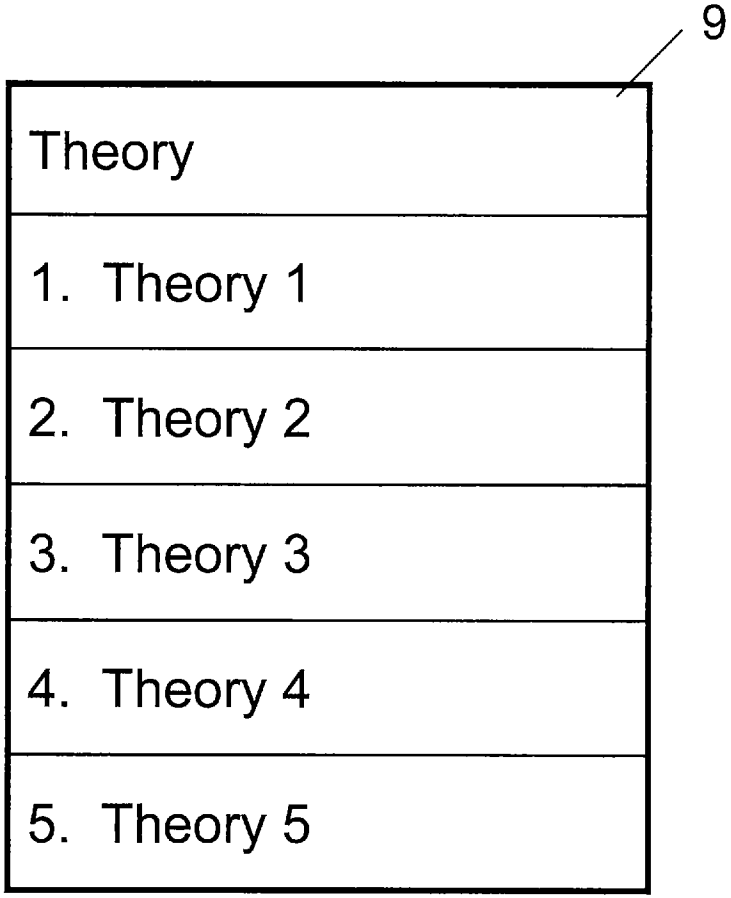
FIG. 3 is a concept diagram showing the fitting theories stored in a fitting theory database 9.

FIG. 3 is a concept diagram showing the fitting theories recorded to the fitting theory database 9.

As shown in FIG. 3, with the hearing aid adjustment device 1 pertaining to this embodiment, five different fitting theories are readied. That is, theories 1 to 5 (examples of a specific method) each refer to a different fitting theory. As shown in FIG. 3, the fitting theories are stored in a reserved storage region of the fitting theory database 9. NAL-NL1 (National Acoustic Laboratories—Non-Linear 1), NAL-NL2, DSL (Desired Sensation Level) i/o, DSL v5, POGO (Prescription Of Gain/Output), and FIG. 6 can be used, for example, as these fitting theories.

The fitting theories are constructed on the basis of what aspect of each will be focused on. For example, a certain fitting theory is constructed by placing emphasis on the fact that the loudness sensed by a user of a hearing aid over the audible frequency band be the same as the loudness sensed by a person with normal hearing. On the other hand, a fitting theory may also be constructed by placing emphasis on language clarity. Therefore, various kinds of hearing aid processing can be provided to the user T by employing a plurality of fitting theories.

When the adjuster S uses the input section 2 to start the adjustment method pertaining to this embodiment, the fitting theories held in the fitting theory database 9 are read by the controller 11. The controller 11 uses as input the hearing level data for the user T stored in the adjustment value memory 12, and calculates initial adjustment parameters suited to the hearing ability level of the user T for each of the fitting theories on the basis of the plurality of fitting theories held in the fitting theory database 9. The initial adjustment parameters referred to here are the initial values for hearing aid processing parameters. More specifically, the term "hearing aid processing parameters" means hearing aid processing parameters in a state before adjustment has been carried out by the adjuster S interactively with the user T.

The calculated initial adjustment parameters are successively sent to the hearing aid 5 and written to the hearing aid processing parameter holder 15 of the hearing aid 5. The user T evaluates how well sounds can be heard for each of the initial adjustment parameters. That is, the initial adjustment parameters are written by the controller 11 to the hearing aid 5 through the writer 13, the connection box 6, and the input section 14 of the hearing aid 5, and are successively evaluated by the user T.

The initial adjustment parameters calculated by the controller 11 may be temporarily stored in the adjustment value memory 12. In this case, the initial adjustment parameters stored in the adjustment value memory 12 are read by the controller 11, sent through the writer 13 and the input section 14 to the hearing aid 5, and written by the hearing aid processor 17 to the hearing aid processing parameter holder 15.

Here, evaluation-use sounds stored in the sound database 21 are provided to the user T through the sound output section 4 so that the sounds can be evaluated by the user T, and the evaluations are inputted by the user T to the hearing aid adjustment device 1 via the input section 2. The evaluation audio is stored in the sound database 21 in a reproducible format (such as a WAV file) with a PC (personal computer). Thus, the sounds are electronic data, for example, in the state in which they are stored in the sound database 21, and are audio when outputted from the sound output section 4.

The term "evaluation" here refers to a subjective decision by the user T about audio outputted from the hearing aid 5. The "hearing" that is the subject of evaluation by the user T is a concept that encompasses both loudness and language clarity, for example.

Evaluation information expressing the evaluation given by the user T for a sound that has undergone hearing aid processing on the basis of a fitting theory is temporarily stored in the adjustment value memory 12. More specifically, an evaluation given for sounds that have undergone hearing aid processing on the basis of each of theories 1 to 5 (an example of a first evaluation) is converted by the controller 11 into evaluation information that can be recorded to the adjustment value memory 12 (an example of first evaluation information). The evaluation information is temporarily stored in the adjustment value memory 12 in a state of being associated with the corresponding fitting theories.

The recommended parameter specification section 22 specifies the hearing aid processing parameters reflected by the subjective preferences of the user T in relation to hearing aid processing. More specifically, the recommended parameter specification section 22 has a comparator 22*a* and a setting section 22*b*.

As discussed above, when evaluations by the user T for all of the initial adjustment parameters are acquired from the input section 2, the recommended parameter specification section 22 specifies the proper hearing aid processing parameters for the user T on the basis of the evaluation results. The hearing aid processing parameters specified by the recommended parameter specification section 22 shall hereinafter be called recommended parameters. In specifying the recommended parameters, the recommended parameter specification section 22 utilizes the evaluation result reported by reference users (such as past customers) in the course of adjusting the hearing aid 5, for whom individual information is stored in the customer database 10.

The customer database 10 (an example of a data storage section) stores data related to adjustment of the hearing aid 5 that has already been completed. The customer database 10 is, for example, a hard disk drive or a flash memory. The data stored in the customer database 10 is made up of hearing level data for reference users (which is necessary for specifying recommended parameters by the recommended parameter specification section 22), evaluation results given by reference users for sounds that underwent hearing aid processing on the basis of various fitting theories, and final adjustment results for the hearing aid 5. In this embodiment, data related to a plurality of users is recorded to the customer database 10.

The phrase "final adjustment results" here refers to hearing aid processing parameters designating hearing aid processing that is suited to reference users, and refers to the hearing aid processing parameters that are ultimately set in the hearing aid 5. "Hearing aid processing suited to reference users" means the hearing aid processing provided by the hearing aid 5 at the stage when the hearing aid 5 was adjusted to a state that was good for the reference users.

In this embodiment, no data that would allow the identity of customers to be specified is recorded to the customer database 10. It is possible for data that specifically identifies customers to be recorded to the customer database 10, but in this case the confidentially of individual customer information is protected by providing the hearing aid adjustment device 1 with some security means.

The terms used in the following description will now be defined.

The hearing level data of individual reference users will be called reference hearing ability data. Hearing aid processing parameters adjusted to suit individual reference users will be called reference parameters. Evaluations given by individual reference users with respect to sounds that have undergone hearing aid processing on the basis of the initial adjustment parameters calculated by application of fitting theories will be called reference evaluations (an example of a second evaluation). That is, a reference evaluation is an evaluation given by a reference user himself for a sound obtained by hearing aid processing based on theories 1 to 5 and reference hearing ability data for individual reference users. Information expressing reference evaluations will be called reference evaluation information (an example of second evaluation information).

Also, data stored in the customer database 10 and corresponding to individual reference users will be called reference data (an example of individual data). The reference data is made up of reference hearing ability data and reference parameters that have been associated with one another.

Meanwhile, hearing level data for the user T will be called user hearing ability data. Hearing aid processing parameters designating hearing aid processing provided to the user T will be called user parameters (an example of a first parameter).

The user parameters are used to express the hearing aid processing parameters stored in the hearing aid processing parameter holder 15 of the hearing aid 5 at the stage when the adjustment of the hearing aid 5 to suit the user T is completed. In addition, the term "user parameters" sometimes refers to the hearing aid processing parameters stored in the hearing aid processing parameter holder 15 or the adjustment value memory 12 at a mid-point in the course of adjusting the hearing aid 5 to suit the user T.

Evaluations given by the user T about sounds that have undergone hearing aid processing on the basis of the initial adjustment parameters calculated by application of fitting theories will be called user evaluations. That is, a user evaluation is an evaluation given by the user T for a sound obtained by hearing aid processing based on the theories 1 to 5 and the user hearing ability data for the user T. Information expressing user evaluations will be called user evaluation information (an example of first evaluation information).

Next, reference data will be described in more specific terms through reference to the drawings.

Figure 4:
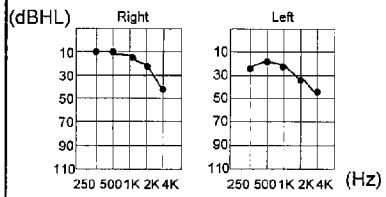
FIG. 4 is a concept diagram showing an example of the data stored in a customer database 10.
Figure 4:
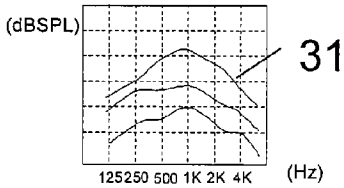
Figure 4:
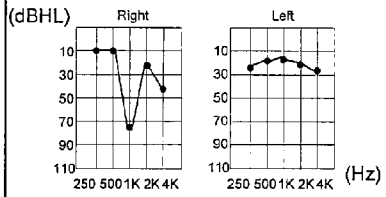
Figure 4:
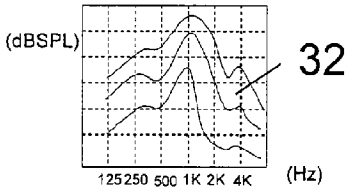
Figure 4:
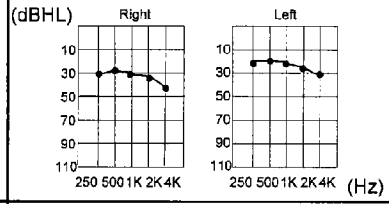
Figure 4:
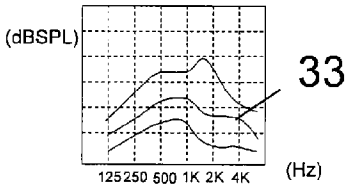
Figure 4:
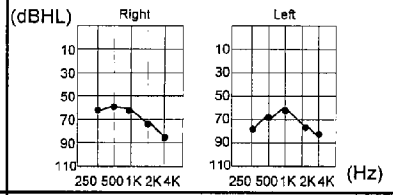
Figure 4:
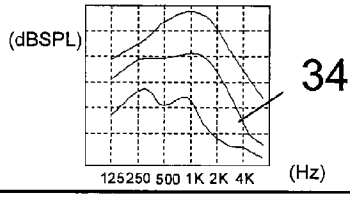

FIG. 4 is a concept diagram showing an example of the reference data stored in the customer database 10.

FIG. 4 shows evaluation results for reference users (that is, reference evaluations), hearing level data for reference users (that is, reference hearing ability data), and final results in adjustment (that is, reference parameters). In FIG. 4, only the final results in adjustment suited to the right ear are shown. Also, in FIG. 4, the final results are given as output curves.

More specifically, FIG. 4 shows the sound pressure level 31 corresponding to the reference parameters for customer A (an example of a reference user), the sound pressure level 32 corresponding to the reference parameters for customer B (an example of a reference user), the sound pressure level 33 corresponding to the reference parameters for customer C (an example of a reference user), and the sound pressure level 34 corresponding to the reference parameters for customer D (an example of a reference user).

In this embodiment, evaluations given by the user T and the reference user are divided into three levels. For example, as shown in FIG. 4, it is recorded that customer A gave an evaluation of G (good) to theory 1 when the sound outputted by the hearing aid 5 was evaluated as being good by customer A on the basis of hearing aid processing corresponding to theory 1. Also, for example, it is recorded that customer A gave an evaluation of S (so-so) to theory 2 when the sound outputted by the hearing aid 5 was evaluated as being fairly good by customer A on the basis of hearing aid processing corresponding to theory 2. Furthermore, for example, it is recorded that customer A gave an evaluation of N (not good) to theory 4 when the sound outputted by the hearing aid 5 was evaluated as being not good by customer A on the basis of hearing aid processing corresponding to theory 4.

In this embodiment, the evaluations given by the user T and the reference users are expressed in three levels, but may be otherwise expressed as long as the evaluations can be categorized and recorded. For example, evaluations in five levels may be used.

The above-mentioned recommended parameter specification section 22 refers to the customer database 10, and identifies as the recommended parameters for the user T the final adjustment results for the reference user who has a hearing level the same as or similar to that of the user T and whose evaluation corresponding to various initial adjustment parameters exhibits the same tendency as that of the user T. The identified recommended parameters are shown on the display section 3. The processing involved in specifying the recommended parameters will be discussed in detail below.

Fitting

The operation of the hearing aid adjustment device 1 during fitting will be described through reference to the drawings, using the adjustment of the hearing aid 5 for the user T as an example.

Figure 5:
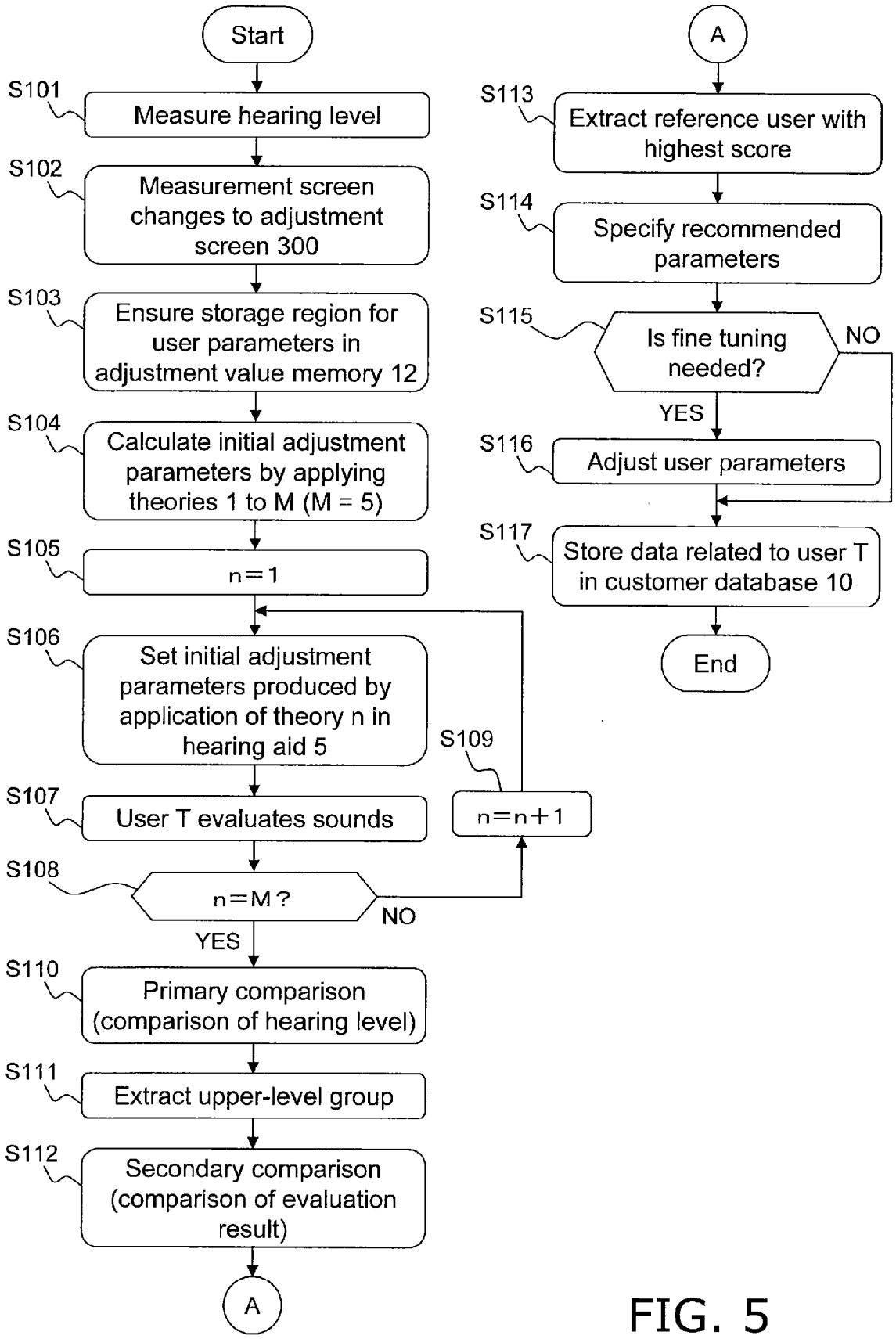
FIG. 5 is a flowchart of hearing aid adjustment in the hearing aid adjustment device 1 in FIG. 1.

FIG. 5 is a flowchart of hearing aid adjustment in the hearing aid adjustment device 1 pertaining to this embodiment.

Step S101

In Step S101, the hearing level of the user T (more specifically, the HTL, etc.) is measured. The measured hearing level data for the user T (that is, the user hearing ability data) is stored in the adjustment value memory 12. Here, hearing level data for the user T that has been acquired ahead of time may be stored in advance in the adjustment value memory 12. During measurement of the hearing level data, a measurement screen is displayed on the display section 3.

Step S102

In step S102, the screen of the display section 3 of the hearing aid adjustment device 1 changes to an adjustment screen 300. More specifically, the controller 11 displays the adjustment screen 300 on the display section 3 instead of the measurement screen.

Figure 6:
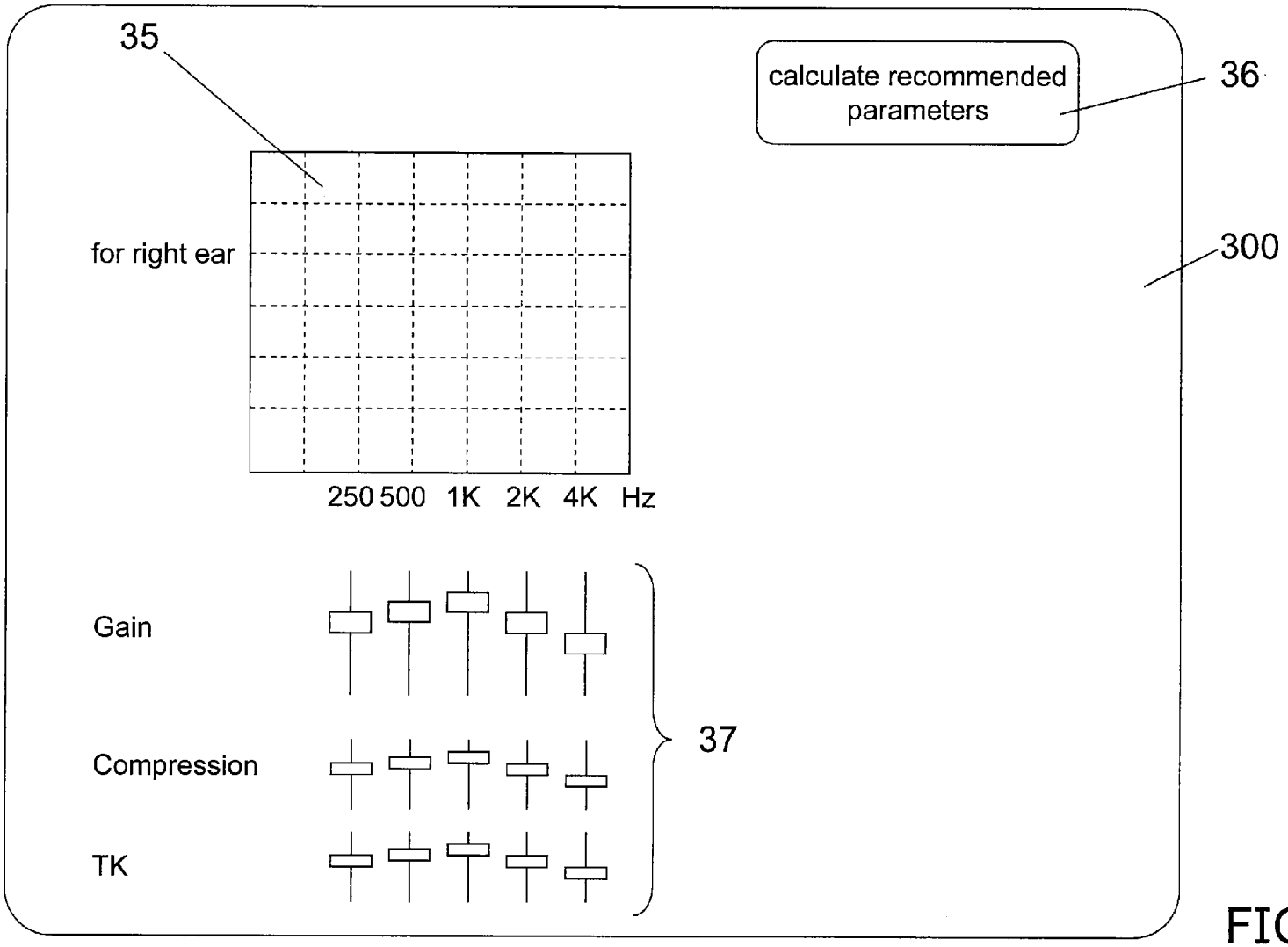
FIG. 6 shows an example of a screen display in the hearing aid adjustment device 1 in FIG. 1.

FIG. 6 shows the adjustment screen 300 displayed on the display section 3.

The slider 37, an adjustment graph 35, and a recommended parameter calculate button 36 are displayed on the adjustment screen 300. As shown in FIG. 6, the adjustment graph 35 is disposed in the upper part of the adjustment screen 300, the slider 37, which is used to adjust various hearing aid processing parameters (more specifically, the gain, compression, and TK), is disposed in the lower part of the adjustment screen 300, and the recommended parameter calculate button 36 is disposed in the upper-right corner of the adjustment screen 300.

The slider 37 shows the magnitude of the hearing aid processing parameters designated by the adjuster S. The adjuster S can use the input section 2 to move the knobs of the slider 37 up and down. The adjuster S then designates the position slider 37 and thereby designates the magnitude of the hearing aid processing parameters.

The output characteristics when hearing aid processing is executed on the basis of the designated hearing aid processing parameters are displayed in the adjustment graph 35.

The recommended parameter calculate button 36 is used to tell the hearing aid adjustment device 1 to execute processing to calculate the recommended parameters. The adjuster S can use the input section 2 to press the recommended parameter calculate button 36 displayed on the display section 3.

A case is described here in which the adjuster S adjusts the hearing aid 5 without relying on the adjustment method pertaining to this embodiment. The adjuster S operates the slider 37 via the input section 2 to set an amplification value suited to the hearing ability of the user T, for each sound frequency band. That is, the hearing aid processing parameters are set for each frequency band. Usually, the adjuster S sets the hearing aid processing parameters by fine tuning some of the initial values. For instance, the parameters calculated using the prescription set previously in a first fitting are used as the initial values for the hearing aid processing parameters. The prescription at the first fitting mentioned here is based on a predetermined fitting theory, for example. Therefore, in this case, in deciding the initial values for the hearing aid processing parameters, just the hearing level data for the user T are taken into account, and not any other subjective preferences.

Meanwhile, with the hearing aid adjustment method pertaining to this embodiment, the initial values for the hearing aid processing parameters are decided on the basis of the subjective preferences of the user T as related to hearing aid processing.

Step S103

In step S103, a storage region is ensured in the adjustment value memory 12 for storing hearing aid processing parameters that designate the hearing aid processing to be provided to the user T (that is, user parameters). More specifically, the controller 11 ensures a storage region in the adjustment value memory 12 for storing user parameters when it is detected that measurement of the hearing level of the user T has ended.

Step S104

In step S104, initial adjustment parameters are calculated by applying theories 1 to M. M here is an integer of at least one expressing the number of fitting theories that will be evaluated by the user T. M=5 in this embodiment.

In step S104, calculation of initial adjustment parameters is begun when the recommended parameter calculate button 36 is pressed by the adjuster S. When the pressing of the recommended parameter calculate button 36 is detected, the controller 11 acquires the data needed to calculate the initial adjustment parameters. That is, the controller 11 acquires the hearing level data for the user T (that is, user hearing ability data) from the adjustment value memory 12, and acquires program data corresponding to the theories 1 to 5 from the fitting theory database 9. The controller 11 executes processing based on the acquired program data, and calculates initial adjustment parameters on the basis of the user hearing ability data.

Figure 7:
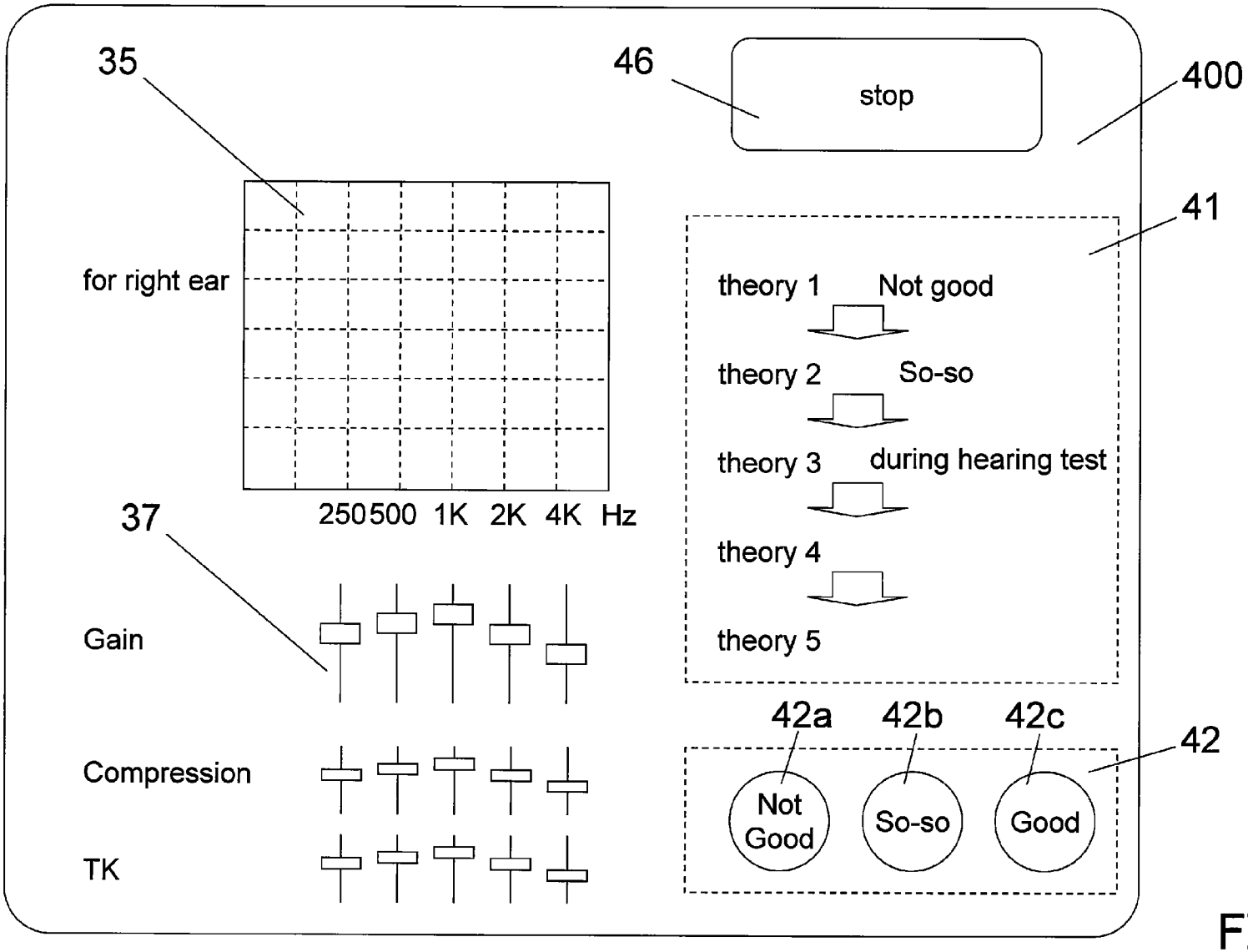
FIG. 7 shows an example of a screen display in the hearing aid adjustment device 1 in FIG. 1.

In step S104, the controller 11 displays an adjustment screen 400 on the display section 3 (see FIG. 7). The adjustment screen 400 will be discussed below.

The initial adjustment parameters corresponding to each of the fitting theories stored in the fitting theory database 9 (the theories 1 to 5 in this embodiment) are calculated here. Therefore, in this embodiment, five sets of initial adjustment parameters are calculated by the controller 11. The calculated initial adjustment parameters are temporarily stored as user parameters in the adjustment value memory 12.

In this embodiment, initial adjustment parameters are calculated ahead of time by the controller 11 for all of the fitting theories stored in the fitting theory database 9, and are stored in the adjustment value memory 12, but the initial adjustment parameters need not be calculated ahead of time. For example, the controller 11 may calculate initial adjustment parameters set in the hearing aid 5 between step S109 (discussed below) in which the theories 2 to 5 are counted off, and step S106 (discussed below) in which initial adjustment parameters are set in the hearing aid 5 for the theories 2 to 5.

As discussed above, in step S104 the initial adjustment parameters to which the various fitting theories have been applied are calculated on the basis of the hearing level data for the user T, and are stored in the adjustment value memory 12.

Step S105

In step S105, a virtual counter for carrying out repeated processing is set and initialized by the controller 11. The count on the counter will hereinafter be referred to as n (n is an integer of at least 1 and no more than M, and in this embodiment, n is an integer of at least 1 and no more than 5). Therefore, in step S105 a value of "1" is assigned to n.

Step S106

In step S106, the initial adjustment parameters calculated by applying the fitting theories are set in the hearing aid 5. More specifically, the initial adjustment parameters calculated on the basis of theory n and the user hearing ability data for the user T are set in the hearing aid 5. For example, when the processing proceeds from step S105 to step S106, initial adjustment parameters calculated by applying theory 1 are set in the hearing aid 5.

As discussed above, the initial adjustment parameters are read from the adjustment value memory 12 by the controller 11, and are sent through the writer 13, the connection box, the wire 7, and the wire 8 to the hearing aid 5. The initial adjustment parameters are then inputted through the input section 14 to the hearing aid 5, and are written by the hearing aid processor 17 to the hearing aid processing parameter holder 15. In this way, the initial adjustment parameters calculated by applying the theory n are set in the hearing aid 5.

Step S107

In step S107, sounds are provided by the hearing aid adjustment device 1 to the user T, and the provided sounds are evaluated by the user T.

As discussed above, the sounds selected by the adjuster S are read by the controller 11 from the sound database 21, and are outputted as evaluation audio from the sound output section 4. The sounds outputted from the sound output section 4 are taken into the hearing aid 5 via the main microphone 16. The sounds taken into the hearing aid 5 are subjected to amplification processing and digital signal conversion processing, after which they are subjected to hearing aid processing by the hearing aid processor 17.

Here, the hearing aid processing to which the sounds are subjected is executed on the basis of the initial adjustment parameters stored in the hearing aid processing parameter holder 15. The initial adjustment parameters set in the hearing aid 5 are calculated by the controller 11 on the basis of the theory n and the user hearing ability data for the user T. Therefore, in the hearing aid 5, hearing aid processing is executed that is based on the theory n and the hearing level data for the user T.

Next, the sounds that have undergone hearing aid processing are subjected to amplification processing and analog signal conversion processing, after which they are outputted as audio from the receiver 18. The user T listens to the audio outputted from the receiver 18 and evaluates them. The evaluations given to the sounds by the user T are inputted by the user T (or the adjuster S) through the input section 2 to the controller 11 of the hearing aid adjustment device 1.

An evaluation given for a sound by the user T can also be called an evaluation of the initial adjustment parameters set in the hearing aid 5, or an evaluation of the theory n used in calculating those initial adjustment parameters.

Furthermore, in step S107, the evaluation given by the user T for the theory n is temporarily stored in the adjustment value memory 12. More specifically, information expressing the evaluation given by the user T for the theory n (that is, user evaluation information) is stored by the controller 11 in the adjustment value memory 12. The user evaluation information corresponding to the theory n here is stored in the adjustment value memory 12 in a state of being associated with the theory n.

The user evaluation information stored in the adjustment value memory 12 is read from the adjustment value memory 12 and stored in the customer database 10 in the processing discussed below.

Step S108

In step S108, it is determined whether or not the number of times n held by the counter is equal to the predetermined integer M. As discussed above, M is the number of fitting theories that will be evaluated by the user T, and M=5 in this embodiment.

The number of fitting theories stored in the fitting theory database 9 does not necessarily coincide with M. If just some of the fitting theories stored in the fitting theory database 9 will be evaluated by the user T, then M will be less than the number of fitting theories stored in the fitting theory database 9.

If the number of times n is equal to M in step S108, the processing proceeds to step S110, and if the number of times n is not equal to M, the processing proceeds to step S109.

Step S109

In step S109, "1" is added to the number of times n held by the counter, and the processing returns to step S106.

As discussed above, in steps S106 to S109, the controller 11 repeats a specific operation, and acquires the evaluation results by the user T for all the initial adjustment parameters obtained from a plurality of fitting theories.

The processing in steps S106 to S109 will now be described through reference to the drawings.

FIG. 7 shows the adjustment screen 400 displayed on the display section 3.

A region 41, a region 42, and a stop button 46 are displayed in addition to the above-mentioned slider 37 and adjustment graph 35 on the adjustment screen 400.

A list of the fitting theories to be evaluated by the user T, and the order thereof, are displayed in the region 41, as are the progress of the evaluation and any evaluation results already obtained. Input buttons 42*a* to 42*c* for inputting the evaluation results by the user T (or the adjuster S) for each fitting theory to the hearing aid adjustment device 1 are disposed in the region 42. The stop button 46 is pressed by the adjuster S via the input section 2. When it is detected that the stop button 46 has been pressed, the controller 11 halts the processing in steps S106 to S109, and halts the processing for designating recommended parameters.

As discussed above, first the controller 11 transmits the initial adjustment parameters obtained by applying a first fitting theory (theory 1) from the adjustment value memory 12 to the hearing aid 5 via the writer 13, the connection box 6, and the input section 14. The transmitted initial adjustment parameters are written by the hearing aid processor 17 to the hearing aid processing parameter holder 15. After this, the controller 11 outputs the sounds stored in the sound database 21 to the sound output section 4 as evaluation audio. The outputted evaluation audio is acquired by the main microphone 16 of the hearing aid 5, subjected to hearing aid processing by the hearing aid processor 17, and then provided to the user T.

Upon hearing a sound outputted from the hearing aid 5, the user T operates the button in the region 42 via the input section 2, and inputs the evaluation result (N, S, or G) for the initial adjustment parameters to the hearing aid adjustment device 1. The evaluation result inputted by the user T to the hearing aid adjustment device 1 is temporarily stored in the adjustment value memory 12, and is finally stored in the customer database 10. This series of evaluation processing is performed on all of the fitting theories stored in the fitting theory database 9.

Step S110

In step S110, primary comparison is executed. That is, the hearing level data for the user T (that is, user hearing ability data) is compared with the hearing level data for the reference users (that is, reference hearing ability data).

More specifically, the comparator 22*a* of the recommended parameter specification section 22 acquires user hearing ability data and reference hearing ability data from the adjustment value memory 12. Here, the reference hearing ability data is read by the controller 11 from the customer database 10, and stored in the adjustment value memory 12. The reference hearing ability data is compared with the user hearing ability data by the comparator 22*a*, and is ranked on the basis of its similarity to the user hearing ability data. That is, a higher rank is given to reference hearing ability data that is more similar to the user hearing ability data. As discussed above, the reference hearing ability data is data expressing the hearing level of reference users for whom adjustment of the hearing aid 5 has already been completed.

The comparator 22*a* of the recommended parameter specification section 22 may also directly acquire user hearing ability data from the controller 11 via the customer database 10.

Step S111

In step S111, users having a hearing level similar to that of the user T are selected from among the reference users for whom adjustment of the hearing aid 5 was completed in the past, and are extracted as a upper-level group. More specifically, a plurality of sets of reference data are extracted in order from the top, on the basis of the order assigned to the reference hearing ability data in step S110, by the comparator 22*a* of the recommended parameter specification section 22.

The reference hearing ability data here forms reference data along with the hearing aid processing parameters adjusted to suit reference users form whom adjustment of the hearing aid 5 was completed in the past (that is, reference parameters), and information expressing the evaluations given by reference users for fitting theories (that is, reference evaluation information). Therefore, the upper-level group extracted in step S111 can be called a group of certain reference users, or a group of certain reference data.

Thus, in steps S110 and S111, reference users whose hearing level is close to that of the user T are extracted from the customer database 10. In order to extract reference users having hearing level data similar to the hearing level data of the user T, for example, hearing level values at various frequencies are expressed as vectors, and the reference users are ranked using the distance between vectors as a reference. The upper-level group can be extracted by a method in which a certain number of reference users that are ranked high are termed "close users" of the user T. Here, the similarity of the hearing level at frequency bands of 1 to 3 kHz may be weighted to place emphasis on the conversation band, among other possible strategies.

For example, user hearing ability data for the user T is expressed as (T250, T500, T1K, T2K, T4K), using a vector section display. Here, T250, T500, T1K, T2K, and T4K are numerical values expressing the hearing level of the user T at frequency bands of 250 Hz, 500 Hz, 1 kHz, 2 kHz, and 4 kHz, respectively. Similarly, reference hearing ability data for one reference user included in the customer database 10 is expressed as (C250, C500, C1K, C2K, C4K). In this case, the distance between vectors for the user hearing ability data and the reference hearing ability data is calculated as $(T250-C250)\times(T250-C250)+(T500-C500)\times(T500-C500)+(T1K-C1K)\times(T1K-C1K)+(T2K-C2K)\times(T2K-C2K)+(T4K-C4K)\times(T4K-C4K)$.

Also, when emphasis is placed on similarity in hearing levels in frequency bands of 1 to 3 kHz, for example, $(T250-C250)\times(T250-C250)+(T500-C500)\times(T500-C500)+W1\times(T1K-C1K)\times(T1K-C1K)+W2\times(T2K-C2K)\times(T2K-C2K)+(T4K-C4K)\times(T4K-C4K)$ can be defined as an index, instead of using the above-mentioned distance between vectors. The weighting W1 and W2 here are positive constants that are set as desired.

Step S112

Secondary comparison is executed in step S112. That is, the score for the evaluations given to fitting theories by reference users included in the upper-level group (that is, reference evaluations) is calculated by the comparator 22*a* of the recommended parameter specification section 22.

More specifically, the evaluations given by the user T for fitting theories (that is, the user evaluation) and the reference evaluations are compared, and a score is assigned to the reference evaluations according to the similarity between the two. Here, if there are two or more fitting theories being evaluated, the comparison of the user evaluation and the reference evaluations is executed for each of the different fitting theories. A score is assigned to the reference evaluations for each fitting theory. Thus, a score is assigned to the reference evaluations for each of the reference users included in the upper-level group, and for each of the fitting theories being evaluated.

In regard to the processing performed by the comparator 22*a* of the recommended parameter specification section 22, comparing the user evaluation and the reference evaluations means comparing the user evaluation information and the reference evaluation information. More precisely, the comparator 22*a* of the recommended parameter specification section 22 acquires user evaluation information about the user T and reference evaluation information about the reference users from the adjustment value memory 12. The reference evaluation information about the reference users here is read by the controller 11 from the customer database 10, and stored in the adjustment value memory 12. A score is assigned to the reference evaluations of the reference users on the basis of the similarity between the acquired user evaluation information and reference evaluation information. The comparator 22*a* of the recommended parameter specification section 22 may also directly acquire reference evaluation information from the customer database 10 via the controller 11.

Scores are also calculated for the individual reference users included in the upper-level group. More specifically, the points assigned for each fitting theory are tallied. This tally is made for each of the reference users included in the upper-level group. The points obtained by tallying are the scores for the individual reference users included in the upper-level group. The scores thus calculated show the degree of similarity between the reference evaluations by reference users included in the upper-level group and the user evaluation given by the user T. That is, it can be said that reference users who gave reference evaluations to which a high score was assigned are closely matched to the user T in terms of subjective preferences toward hearing aid processing.

The scores for reference evaluations by reference users can also be said to be scores for reference users who gave those reference evaluations.

The scores for reference evaluations by reference users included in the upper-level group are temporarily stored in the adjustment value memory 12. The scores for reference evaluations are stored in the adjustment value memory 12 in a state of being mutually associated with reference data for the reference users who gave the reference evaluations.

Step S113

In step S113, the person having the highest score among the reference users is extracted from the upper-level group. More specifically, the comparator 22*a* of the recommended parameter specification section 22 compares the scores of the reference users included in the upper-level group, and the reference user having the highest score is specified.

Thus, in steps S112 and S113, the individual whose evaluation of initial adjustment parameters was most similar to that of the user T is extracted from the set of reference users whose hearing level is close to that of the user T (that is, the upper-level group), which was extracted in step S111.

The processing in steps S110 to S113 will now be described through reference to the drawings.

Figure 8:
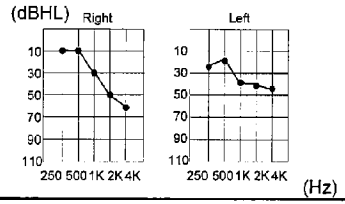
FIG. 8 is a concept diagram of processing in a recommended parameter specification section 22.
Figure 8:
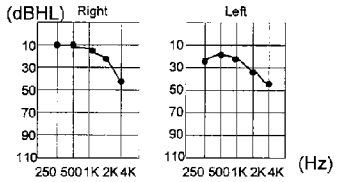
Figure 8:
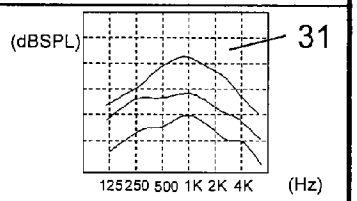
Figure 8:
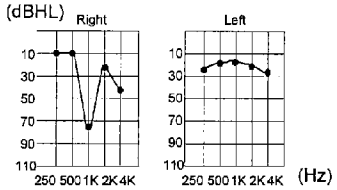
Figure 8:
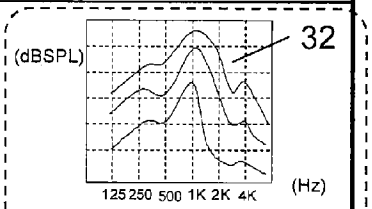
Figure 8:
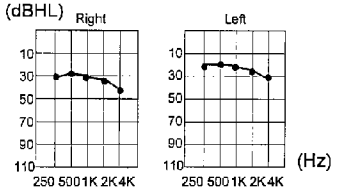
Figure 8:
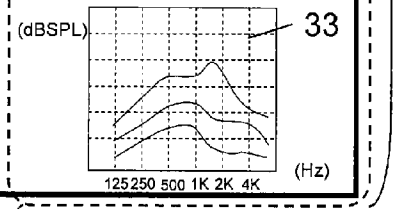

FIG. 8 is a concept diagram illustrating the processing of the recommended parameter specification section 22.

As shown in FIG. 8, in steps S110 to S113, user evaluation information, user hearing ability data, reference evaluation information, reference evaluation scores, and reference hearing ability data are temporarily stored in the adjustment value memory 12. In step S114 (discussed below), reference parameters for customer A are temporarily stored in the adjustment value memory 12. In FIG. 8, the reference parameters for customer A are shown by the sound pressure level 31 based on the reference parameters of customer A, for the sake of illustration.

For the sake of reference, FIG. 8 also shows the sound pressure level 32 based on the reference parameters for customer B and the sound pressure level 33 based on the reference parameters for customer C. However, the reference parameters for customers B and C need not be read from the customer database 10 to the adjustment value memory 12. In order to show this, the sound pressure level 32 and the sound pressure level 33 are enclosed by a broken line in FIG. 8.

As shown in FIG. 8, in step S110 the reference hearing ability data for the reference users is read from the customer database 10 and compared with the user hearing ability data for the user T.

Furthermore, in this embodiment the comparator 22*a* of the recommended parameter specification section 22 assigns a score to the reference evaluations of the reference users for each of the fitting theories. More specifically, if the reference evaluation of a reference user is the same as the user evaluation of the user T, +3 points are assigned to the reference evaluation. If the reference evaluation of a reference user is "not good" or "good" and the user evaluation of the user T is "so-so," or if the reference evaluation of a reference user is "so-so" and the user evaluation of the user T is "not good" or "good,"+1 point is assigned to the reference evaluation. Also, if the reference evaluation of a reference user is the exact opposite of the user evaluation of the user T, −1 point is assigned to the reference evaluation.

If the reference evaluation of a reference user is "not good" and the user evaluation of the user T is "good," or if the reference evaluation of a reference user is "good" and the user evaluation of the user T is "not good," this corresponds to a case in which the reference evaluation of a reference user is the exact opposite of the user evaluation of the user T.

By assigning points in this way, the reference user who gave the evaluation most similar to that of the user T for a fitting theory is extracted.

In the specific example shown in FIG. 8, in step S111 we will assume a state in which customer A, customer B, and customer C having hearing levels close to that of the user T have been extracted. That is, there are three reference users included in the upper-level group: customers A, B, and C. The number of reference users who make up the upper-level group here was set at three in order to simplify the explanation, but the number of reference users included in the upper-level group is not limited to three. For example, the upper-level group may be formed by extracting a certain upper-level L people (where L is an integer of at least 1), such as having several dozen reference users make up the upper-level group.

As discussed above, in step S112, scores are assigned to the reference evaluations for each of the initial adjustment parameters on the basis of a comparison of the user evaluation given by the user T and the reference evaluations given by customers A to C. More specifically, scores indicating closeness (that is, similarity) between the user evaluation given by the user T and the reference evaluations given by customers A to C were calculated as follows.

$$RA=SA1+SA2+SA3+SA4+SA5 \quad (1)$$

$$SA1=3 \quad (1a)$$

$$SA2=3 \quad (1b)$$

$$SA3=1 \quad (1c)$$

$$SA4=3 \quad (1d)$$

$$SA5=3 \quad (1e)$$

$$RB=SB1+SB2+SB3+SB4+SB5 \quad (2)$$

$$SB1=-1 \quad (2a)$$

$$SB2=1 \quad (2b)$$

$$SB3=1 \quad (2c)$$

$$SB4=-1 \quad (2d)$$

$$SB5=-1 \quad (2e)$$

$$RC=SC1+SC2+SC3+SC4+SC5 \quad (3)$$

$$SC1=1 \quad (3a)$$

$$SC2=3 \quad (3b)$$

$$SC3=3 \quad (3c)$$

$$SC4=1 \quad (3d)$$

$$SC5=3 \quad (3e)$$

In Formula 1 above, RA expresses the score for customer A. SA1 to SA5 respectively correspond to fitting theories 1 to 5, and express the scores assigned to the reference evaluation of customer A. Formulas 1a to 1e express the values of SA1 to SA5 in the specific example shown in FIG. 8. From Formulas 1 and 1a to 1e it can be seen that the score RA for customer A in this example is 13 points.

Similarly, in Formula 2, RB expresses the score for customer B. SB1 to SB5 respectively correspond to fitting theories 1 to 5, and express the scores assigned to the reference evaluation of customer B. Formulas 2a to 2e express the values of SB1 to SB5 in the specific example shown in FIG. 8. From Formulas 2 and 2a to 2e it can be seen that the score RB for customer B in this example is −1 point.

Similarly, in Formula 3, RC expresses the score for customer C. SC1 to SC5 respectively correspond to fitting theories 1 to 5, and express the scores assigned to the reference evaluation of customer C. Formulas 3a to 3e express the values of SC1 to SC5 in the specific example shown in FIG. 8. From Formulas 3 and 3a to 3e it can be seen that the score RC for customer C in this example is 11 points.

From the above results, the comparator 22*a* of the recommended parameter specification section 22 determines that the reference evaluation of customer A is closest to the user evaluation of the user T.

What is described above is just one specific example, but the method for determining the similarity of the evaluation results is not limited to the method described above.

For example, if the user evaluation of the user T matches the reference evaluation of a reference user, a score of "1" may be assigned to that reference evaluation, and if there is no match, the score may be "0." That is, the scores of the reference evaluations of reference users may be calculated by counting the number of fitting theories in which the user evaluation of the user T matches the reference evaluation of a reference user. For instance, if the evaluation result shown in FIG. 8 is obtained, then SA1=1, SA2=1, SA3=0, SA4=1, and SA5=1, so RA=4. Meanwhile, SB1=SB2=SB3=SB4=SB5=0, so RB=0.

Also, the scores for reference users were calculated on the basis of reference evaluations above, but the similarity of hearing levels may be reflected in the scores of the reference users. For example, if there are two or more reference users who gave exactly the same reference evaluations, then a higher score may be assigned to reference users with higher similarity of hearing levels.

Also, the number of first fittings that are evaluated may be increased. The term "first fitting" here means processing to calculate initial adjustment parameters. The initial adjustment parameters are calculated for each of the fitting theories by the controller 11. Therefore, to increase the number of first fittings, the number of fitting theories to be evaluated (that is, M) may be increased, for example.

Step S114

In step S114, the recommended parameters for the user T are specified. More specifically, hearing aid processing parameters adjusted to suit a certain reference user (that is, reference parameters) are extracted from the customer database 10 by the setting section 22*b* of the recommended parameter specification section 22 and designated as recommended parameters. The certain reference user here is the user determined to have the highest score in step S113, and in this embodiment it is customer A. Also, the reference parameters extracted from the customer database 10 by the setting section 22*b* of the recommended parameter specification section 22 are the hearing aid processing parameters ultimately set in the hearing aid 5 when the hearing aid 5 is adjusted to suit the customer A. The specified reference parameters are designated as the recommended parameters for the user T.

More precisely, in step S114, the setting section 22*b* of the recommended parameter specification section 22 acquires the reference data stored in the customer database 10 via the controller 11, and stores it in the adjustment value memory 12. The reference data for the reference user who was given the highest score is acquired from the customer database 10. The reference parameters included in the acquired reference data are designated as recommended parameters.

Thus, in step S113, the final results obtained in adjusting the hearing aid 5 to suit customer A (that is, the reference parameters) are selected and employed as recommended parameters for the user T.

Also, in step S114, the setting section 22*b* of the recommended parameter specification section 22 sets the recommended parameters as the tentative hearing aid processing parameters for the user T. More specifically, the setting section 22*b* of the recommended parameter specification section 22 goes through the controller 11 to set the values of the user parameters stored in the adjustment value memory 12 to be the same as the values of the recommended parameters. That is, the setting section 22*b* tentatively sets the values for the user parameters designating the hearing aid processing to be provided to the user T to be the same as those for the reference parameters designating the hearing aid processing suited to customer A. In other words, the recommended parameters can be called the initial values for the hearing aid processing parameters used to adjust the hearing aid 5 in interactive fitting.

Figure 9:
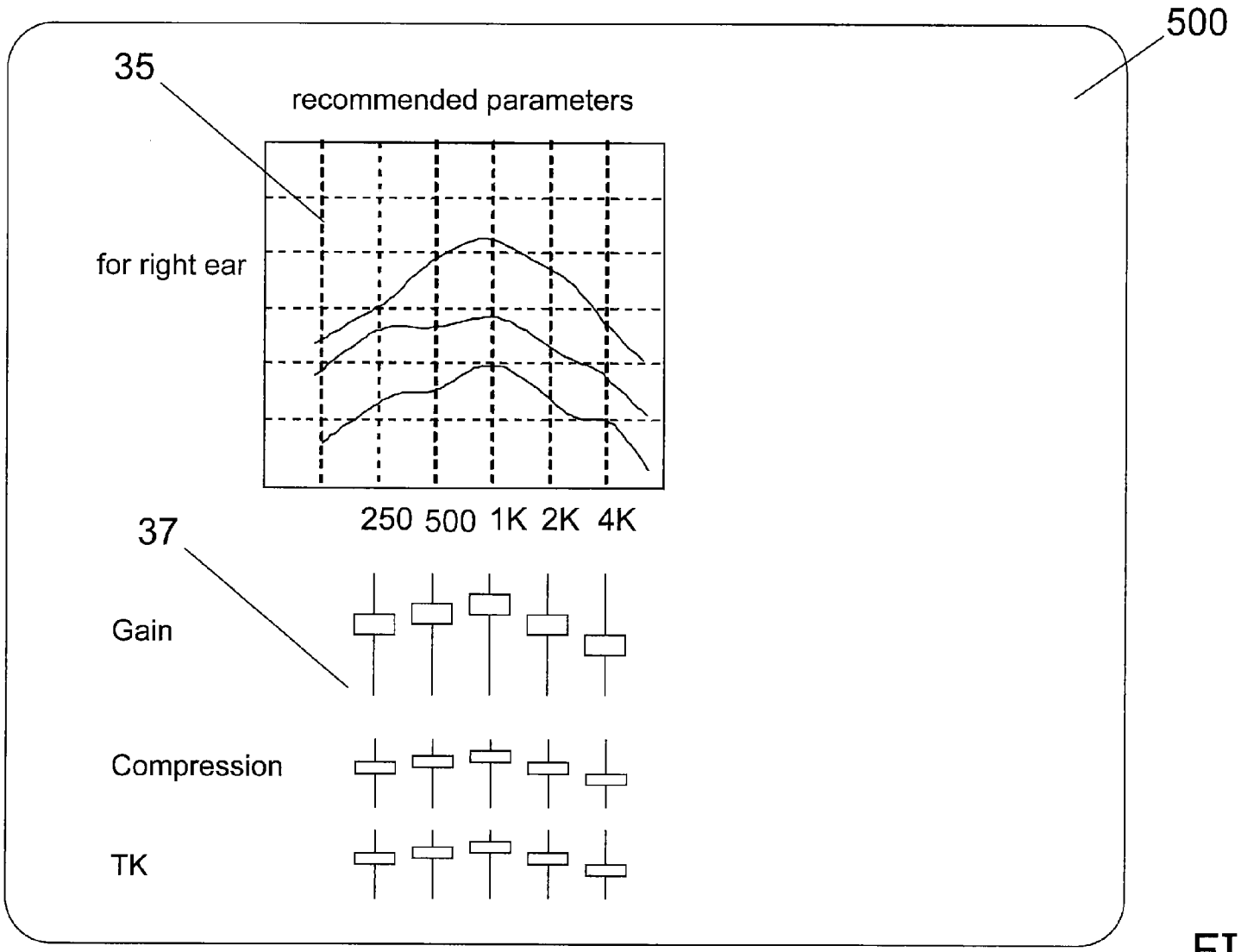
FIG. 9 shows an example of a screen display in the hearing aid adjustment device 1 in FIG. 1.

Furthermore, in step S114 the controller 11 displays an adjustment screen 500 on the display section 3. FIG. 9 shows the adjustment screen 500.

As shown in FIG. 9, the slider 37 and the adjustment graph 35 are displayed on the basis of the recommended parameters on the adjustment screen 500. On the adjustment screen 500, the state of the slider 37 and the adjustment graph 35 is substantially the same as that of the final results obtained when adjusting the hearing aid 5 to suit customer A. That is, the sound pressure level displayed in the adjustment graph 35 on the adjustment screen 500 is the same as the sound pressure level 31 corresponding to the reference parameters for customer A. Thus, the final results for customer A are displayed as shown in FIG. 9 as the recommended parameters for the user T. The three curves displayed in the adjustment graph 35 show the output values (sound pressure levels) at 90, 60, and 40 dB SPL, respectively, starting from the top.

Step S115

In step S115 the user T decides whether or not the user parameters need to be fine tuned any further.

More specifically, the user T listens to sound that has undergone hearing aid processing on the basis of the recommended parameters specified in step S114. The user T then decides whether or not the test sound was good.

If the user T decides that the test sound was good, the recommended parameters can be called the optimal or sub-optimal hearing aid processing parameters for the user T. Also, since the values of the user parameters are set to be the same as the values for the recommended parameters, the user parameters can be called the optimal or sub-optimal hearing aid processing parameters for the user T. Therefore, if the user T determines the test sound to be good, there is no need for further adjustment of the user parameters, so the flow of the fitting proceeds to step S117. In step S117 the adjustment of the hearing aid 5 ends.

Thus, there are times when the adjustment of the hearing aid 5 ends with just the first fitting. The term "first fitting" here means the series of processing and operations for designating the recommended parameters.

On the other hand, there will be times when the user T is not satisfied with the sound that has undergone hearing aid processing on the basis of the recommended parameters. In this case, the user T decides that the user parameters need further adjustment. The flow of the fitting then proceeds to step S116.

Step S116

In step S116 the adjuster S adjusts the user parameters to suit the user T. More specifically, the adjuster S fine tunes the user parameters to suit the user T, using the recommended parameters as the initial values for the user parameters.

The adjustment in step S116 here is executed by an interactive method. That is, a process in which the hearing aid processing parameters are set in the hearing aid 5, a process in which the user T listens to and evaluates sounds, and a process in which the adjuster S adjusts the hearing aid processing parameters on the basis of the evaluation from the user T are repeated. The input section 2 is operated by the adjuster S in adjusting the hearing aid processing parameters. The adjustment of the hearing aid 5 ends at the stage when the hearing aid 5 has been adjusted to a state that is good for the user T.

Thus, with the hearing aid adjustment method pertaining to this embodiment, fine tuning of the user parameters is not necessarily always carried out. Fine tuning of the user parameters is carried out as needed, at the discretion of the user T.

Step S117

In step S117 data related to the user T is stored in the customer database 10. More specifically, user evaluation information corresponding to the theories 1 to 5, user hearing ability data for the user T, and hearing aid processing parameters adjusted to suit the user T (that is, user parameters) are stored in the customer database 10. More precisely, when a command to end adjustment is inputted by the adjuster S through the input section 2 to the controller 11, the controller 11 executes processing to end adjustment. That is, the controller 11 stores the hearing aid processing parameters ultimately set in the hearing aid 5, user hearing ability data for the user T, and user evaluation information expressing the evaluations given by the user T for the fitting theories, in the customer database 10 in a state of being associated with one another. This data is read from the adjustment value memory 12 by the controller 11 and stored in the customer database 10.

The above-mentioned information obtained in adjusting the hearing aid 5 to suit the user T is stored as reference data in the customer database 10. Therefore, the information related to the user T can be used in adjusting the hearing aid 5 to suit another user by using the hearing aid adjustment method pertaining to this embodiment.

The adjustment of the hearing aid 5 is carried out as above.

By thus calculating the recommended parameters on the basis of the hearing aid adjustment method pertaining to this embodiment, the initial values of the hearing aid processing parameters (more specifically, the user parameters) can be set more suitably. If the first fitting is merely carried out by applying each of the fitting theories, it will be difficult to reflect the subjective preferences of the user T in the hearing aid processing parameters. That is, there may be times when the preferences of the user T need to be ascertained by interactive adjustment after the first fitting. Therefore, when a conventional hearing aid adjustment method is used, adjustment of the hearing aid processing parameters and test hearing by the user T need to be carried out additionally.

On the other hand, with the hearing aid adjustment method pertaining to this embodiment, it is relatively easy to find hearing aid processing parameters that include preferences to sounds for each person which were difficult to ascertain. That is, with this embodiment, initial adjustment parameters can be calculated by a first fitting carried out by applying no more than a few (five in this embodiment) fitting theories. The user T then evaluates the sounds that have undergone hearing aid processing on the basis of these few initial adjustment parameters. Therefore, hearing aid processing parameters that reflect the preferences of the user T (that is, recommended parameters) can be found merely by having the user T evaluate how sounds are heard a few times (five times in this embodiment). The recommended parameters thus obtained can be set as the initial values for the user parameters.

If the hearing aid processing based on the recommended parameters is suited to the user T, then the recommended parameters themselves can be used as the hearing aid processing parameters for the user T.

Thus, with the hearing aid adjustment method pertaining to this embodiment, sub-optimal hearing aid processing parameters for a user T can be calculated in less time than with a conventional method entailing a genetic algorithm, which required adjustment to be repeated dozens or even hundreds of times.

Action and Effect

The action and effect of the hearing aid adjustment device 1 and the hearing aid adjustment method pertaining to this embodiment will now be described.

(1)

With the hearing aid adjustment device 1, the comparator 22*a* of the recommended parameter specification section 22 compares the user evaluation given by the user T with respect to sound obtained by hearing aid processing based on the theories 1 to 5 and the user hearing ability data of the user T, with the reference evaluations given by customers A to C for sound obtained by hearing aid processing based on the theories 1 to 5 and the reference hearing ability data for customers A to C, acquired ahead of time and corresponding to customers A to C.

The setting section 22*b* of the recommended parameter specification section 22 sets the value of the user parameters designating the hearing aid processing to be provided to the user T, to be the same as the value of the reference parameters designating hearing aid processing suited to customer A who gave a reference evaluation similar to the user evaluation of the user T.

Thus, with the hearing aid adjustment device 1, the user T and customer A evaluate sound obtained by hearing aid processing based on the theories 1 to 5, which are shared fitting theories. Here, since the user evaluation given by the user T is similar to the reference evaluation given by customer A, the subjective preferences of the user T as related to hearing aid processing can be said to be similar to the subjective preferences of customer A. Therefore, if the value of the user parameters for the user T are set to be the same as the value of reference parameters for customer A, then the subjective preferences of the user T as related to hearing aid processing will be reflected by the user parameters of the user T.

Consequently, the subjective preferences of the user T as related to hearing aid processing can be reflected by the user parameters merely by having the user T evaluate sound obtained by hearing aid processing based on the theories 1 to 5. That is, there is no need for extra repetition of the adjustment of hearing aid processing parameters to find the subjective preferences of the user T.

As a result, it is easier to adjust the hearing aid 5 to suit the user T, and hearing aid processing parameters can be set that are more appropriate for the user T.

(2)

With this hearing aid adjustment device 1, the hearing aid processing for obtaining the sound to be evaluated by the user T and customer A is designated on the basis of the theories 1 to 5, which are a plurality of fitting theories.

Consequently, the user T is provided with a plurality of kinds of evaluation audio on the basis of hearing aid processing obtained by the application of a plurality of fitting theories. That is, since there are more selection options for hearing aid processing than when just one fitting theory is applied, it is easier to specify hearing aid processing that is matched to the individual preferences of the user T.

As a result, hearing aid processing parameters that reflect the subjective preferences of the user T can be found more quickly.

Also, since the reference evaluations are compared with the user evaluation corresponding to a plurality of fitting theories, the decision about similarity is more accurate than when just a single fitting theory is applied.

(3)

With this hearing aid adjustment device 1, reference hearing ability data for customer A, reference parameters for customer A, and reference evaluation information expressing the reference evaluations of customer A are associated with one another and stored as reference data in the customer database 10. Also, the comparator 22*a* of the recommended parameter specification section 22 acquires reference evaluation information for customer A from the customer database 10. Furthermore, the setting section 22*b* of the recommended parameter specification section 22 acquires reference parameters for customer A from the customer database 10.

Thus, the customer database 10 holds not just reference evaluation information, but also reference parameters that have been associated with the reference evaluation information.

Consequently, the setting section 22*b* can easily refer to these reference parameters, so with the hearing aid adjustment device 1 it is possible for reference parameters that are appropriate for the user T to be specified more quickly.

(4)

With this hearing aid adjustment device 1, the comparator 22*a* of the recommended parameter specification section 22 selects from the customer database 10 a plurality of sets of reference data including reference hearing ability data that matches or is similar to the user hearing ability data for the user T, and forms an upper-level group.

Furthermore, the comparator 22*a* of the recommended parameter specification section 22 specifies reference data for customer A that includes reference evaluation information expressing reference evaluations that are similar to the user evaluation of the user T, from among the upper-level group.

Thus, the upper-level group is formed on the basis of hearing level data for the user T, so the hearing level data for the reference users in this upper-level group is similar to that of the user T. That is, customer A extracted from the upper-level group is similar to the user T in terms of hearing level measured relatively objectively, and has given an evaluation similar to that of the user T with respect to a first fitting based on the theories 1 to 5. Because the comparison is thus carried out on the basis of hearing level and evaluation results, it can be more reliably decided that the user T and customer A are similar in how they hear sounds. As a result, the hearing aid processing parameters suited to customer A can be considered sub-optimal hearing aid processing parameters for the user T.

Accordingly, sub-optimal hearing aid processing parameters for the user T can be obtained merely by extracting the reference user whose evaluation of a first fitting based on the theories 1 to 5 is similar to that of the user T from the upper-level group, and referring to the hearing aid processing parameters for the extracted reference user (customer A)

(5)

With this hearing aid adjustment device 1, the input section 2 is operated to adjust the user parameters so as to designate hearing aid processing that is suited to the user T.

Here, the value of the user parameters is set to be the same as the value of the reference parameters for customer A, so the subjective preferences of the user T are already reflected to a certain extent. The adjuster S can then further adjust the user parameters by using the input section 2.

Consequently, compared to when a decision is made without the initial value of the user parameters reflecting the subjective preferences of the user T, it takes far less time to obtain final user parameters suited to the user T.

(6)

With the hearing aid adjustment method pertaining to this embodiment, the initial adjustment parameters are calculated on the basis of the theories 1 to 5 and the hearing level data for the user T, and hearing aid processing based on these initial adjustment parameters may include compression processing and TK processing.

Consequently, sound obtained by various kinds of hearing aid processing is provided to the user T and evaluated, so it is easier to find hearing aid processing parameters that are best suited to the subjective preferences of the user T.

(7)

With the hearing aid adjustment method pertaining to this embodiment, NAL-NL1, NAL-NL2, DSL i/o, DSL v5, POGO, FIG. 6, and other such fitting theories can be used, for example. These fitting theories each have their own unique features. Since each of the fitting theories involves calculating hearing aid processing parameters from a different perspective with respect to the user's hearing, different initial adjustment parameters are obtained with each fitting theory even though the same hearing level data is used. Therefore, various kinds of initial adjustment parameters are obtained by applying a plurality of fitting theories. Since the user evaluates sound that has undergone hearing aid processing based on various initial adjustment parameters, it is easier to find hearing aid processing that is suited to the perceptions of the user.

If we focus on evaluations of various initial adjustment parameters by the user, a pattern in which the individual characteristics (sound preferences) of the user are reflected is expressed by these evaluations. On the other hand, users' sound preferences often exhibit common tendencies. For example, if a plurality of users have similar hearing ability, these users may have a tendency to have similar preferences for sound. Therefore, some users who have already completed adjustment of a hearing aid are likely to have individual characteristics that are similar to those of users who will be trying to adjust the same hearing aid in the future.

In view of this, with the hearing aid adjustment method pertaining to this embodiment, individuals having the same individual characteristics as a user who is trying to adjust a hearing aid are chosen from among customers who have completed adjustment in the past. That is, the ideal individuals are specified from among a database of many people, using similarity in evaluation patterns as a reference. The final adjustment results for the specified individuals (that is, the hearing aid processing parameters ultimately set in the hearing aid) are referred to. Consequently, adjustment results that reflect individual characteristics (correspond to those obtained by fine tuning from the initial adjustment parameters), which cannot be found merely by an ordinary first fitting, can be found with ease.

As discussed above, in the past a patient had to undergo a lot of hearing testing and repeated evaluation, in which hearing aid processing parameters that suited the user would sought. With the hearing aid adjustment method pertaining to this embodiment, however, hearing aid processing parameters that reflect the individual characteristics of the user can be found merely by performing hearing testing and evaluation a few times at most.

Other Embodiments

An embodiment of the present invention was described above, but the present invention is not limited to or by the above embodiment, and various modifications are possible without departing from the gist of the invention.

(A)

In the above embodiment, in steps S112 and S113, only the final result (that is, reference parameters) for customer A who was given the highest score was extracted, but the final results for a plurality of reference users may be extracted instead.

For example, reference parameters can be extracted for the upper P people (where P is an integer of at least 2) who were given high scores, and the user T can listen to and compare sounds that have undergone hearing aid processing based on these P number of reference parameters. Thus, a plurality of sets of recommended parameters may be specified. In this case, reference parameters for a plurality of reference users who were given high scores may be read from the customer database 10 to the adjustment value memory 12 (see FIG. 8).

In the above embodiment, sub-optimal hearing aid processing parameters were provided as recommended parameters to the user T by comparison between the user evaluation of the user T and the reference evaluations of the reference users. However, the evaluation by the user T of sound that has undergone hearing aid processing on the basis of a recommended parameter tends to be subjective. That is, in a state in which the user cannot tell one sound from another, it is possible that the user T will decide that a sound that has undergone hearing aid processing on the basis of the one recommended parameter is not suited to his own subjective preferences. If this happens, it is possible to improve the user T's own agreement by having the user T listen to and compare sounds processed on the basis of P number of reference parameters given a high score.

(B)

In the above embodiment, the customer database 10 was built into the hearing aid adjustment device 1, but reference data may instead be recorded to a recording medium or recording device that is not built into the hearing aid adjustment device 1.

For example, the hearing aid adjustment device 1 may be connected by wire or via wireless communication with a server having a recording medium to which reference data has been recorded. In this case, reference data is sent from the server to the hearing aid adjustment device 1 at the request of the hearing aid adjustment device 1.

Also, the various processing in the above embodiment was executed by a computer built into the hearing aid adjustment device 1, but the processing may instead be executed by an apparatus connected externally to the hearing aid adjustment device 1.

For example, a multipurpose PC in which a specific application software has been installed may communicate with an external computer, thereby realizing the hearing aid adjustment method pertaining to the above embodiment. In this case, for example, hearing level data about the user T is sent to the external computer, and the external computer calculates the initial adjustment parameters on the basis of fitting theories. Also, the user evaluation of the user T is sent to the external computer and compared with reference evaluations of reference users.

(C)

The various processing in the above embodiment may be done with hardware, or may be done with software (including an operating system (OS), middleware, or a specific library). Furthermore, the various processing in the above embodiment may be done by a mixture of software and hardware. The program constituting the software here can be supplied via a memory card, a CD-ROM, or another such recording device or recording medium, or the Internet or another such transmission medium.

It should go without saying that when the processing of the above embodiment is done with hardware, the timing at which the various processing is performed will need to be adjusted. In the above embodiment, details about adjusting the timing of the various signals produced in an actual hardware design were omitted to simplify the description.

Also, the order in which the processing methods were executed in the above embodiment is not necessarily limited to what was given in the above embodiment, and another execution order may be substituted without departing from the gist of the invention.

(D)

In the above embodiment, the hearing aid 5 and the hearing aid adjustment device 1 were connected via the connection box 6, the wire 7, and the wire 8, but how the hearing aid and the hearing aid adjustment device 1 are connected is not limited to a wired method.

For example, the hearing aid 5 and the hearing aid adjustment device 1 may be connected by wireless communication.

(E)

In the above embodiment, reference data was described using the data from past customers as an example, but the reference data stored in the customer database 10 is not limited to being supplied from customers.

For example, a personal survey may be conducted and a database produced using data supplied from the survey-takers may be used in place of the customer database 10.

(F)

In the above embodiment, the comparator 22*a* and the setting section 22*b* were provided to the recommended parameter specification section 22, but these need not be provided separately.

For example, the recommended parameter specification section 22 may realize the functions of the comparator 22*a* and the setting section 22*b* by switching between operating functions.

Also, in the above embodiment, the controller 11 and the recommended parameter specification section 22 were provided separately, but these functional sections need not be provided separately.

For example, the controller 11 may also function as the recommended parameter specification section 22.

INDUSTRIAL APPLICABILITY

The hearing aid adjustment device of the present invention has the effect of reducing the number of times a hearing aid user has to undergo hearing testing and evaluation, while yielding hearing aid processing parameters that reflect how the hearing aid user hears sounds. Therefore, this device can be widely applied to hearing aid adjustment devices that adjust various kinds of hearing aid.

REFERENCE SIGNS LIST

1 hearing aid adjustment device
2 input section
3 display section
4 sound output section
5 hearing aid
6 connection box
7, 8 wire
9 fitting theory database
10 customer database (an example of a data storage section)
11 controller
12 adjustment value memory
13 writer
14 input section
15 hearing aid processing parameter holder
16 main microphone
17 hearing aid processor
18 receiver
19 output section
20 reader
21 sound database
22 recommended parameter specification section
22*a* comparator
22*b* setting section
T user
S adjuster
A to D customers (an example of reference users)

The invention claimed is:

1. A hearing aid adjustment device, comprising:

a comparator configured to compare a first evaluation given by a hearing aid user in response to sound obtained by hearing aid processing based on a specific method and the hearing level data for the user, and a second evaluation acquired ahead of time and corresponding to each of a plurality of reference users, and given by the reference users in response to sound obtained by hearing aid processing based on the specific method and the hearing level data for the reference users; and a setting section configured to set the value of a first parameter designating hearing aid processing to be given to the user, to a value that is the same as the value of a second parameter that is acquired ahead of time and designates hearing aid processing suited to those reference users who gave a second evaluation that matched or was similar to the first evaluation, out of the plurality of reference users.

2. The hearing aid adjustment device according to claim 1, wherein the specific method is a plurality of fitting theories, and the first evaluation and the second evaluation each include a plurality of evaluations corresponding to the plurality of fitting theories.

3. The hearing aid adjustment device according to claim 1, further comprising a data storage section in which hearing level data for each of the reference users, the second parameter, and second evaluation information expressing the second evaluation are stored as individual data that are associated with each other, wherein the comparator acquires the second evaluation information from the data storage section, and the setting section acquires the second parameter from the data storage section.

4. The hearing aid adjustment device according to claim 3, wherein the comparator selects a plurality of the individual data, including hearing level data that matches or is similar to the hearing level data of the user, from the data storage section, and specifies the individual data including the second evaluation information that matches or is similar to first evaluation information expressing the first evaluation of the user, from among the plurality of selected individual data.

5. The hearing aid adjustment device according to claim 1, further comprising an input section that is operated to adjust the value of the first parameter so as to designate hearing aid processing that suits the user.

6. A hearing aid adjustment method for adjusting a hearing aid to suit a user, comprising the steps of:

acquiring, from a data storage section, second evaluation information expressing a second evaluation given by a plurality of reference users in response to sound that is stored ahead of time in the data storage section and corresponding to each of the reference users and that is obtained by hearing aid processing based on a specific method and hearing level data for the reference users;

comparing the second evaluation information acquired from the data storage section with first evaluation information expressing a first evaluation given by the user in response to sound obtained by hearing aid processing based on the specific method and hearing level data for the user; and setting the value of a first parameter designating hearing aid processing to be given to the user, to a value that is the same as the value of a second parameter that has been stored ahead of time in the data storage section and designates hearing aid processing suited to those reference users who gave a second evaluation that matched or was similar to the first evaluation, out of the plurality of reference users.

7. A hearing aid setting program for causing a computer to execute a hearing aid adjustment method for adjusting a hearing aid to suit a user, said hearing aid adjustment method comprising the steps of:

acquiring, from a data storage section, second evaluation information expressing a second evaluation given by a plurality of reference users in response to sound that is stored ahead of time in the data storage section and corresponding to each of the reference users and that is obtained by hearing aid processing based on a specific method and hearing level data for the reference users;

comparing the second evaluation information acquired from the data storage section with first evaluation information expressing a first evaluation given by the user in response to sound obtained by hearing aid processing based on the specific method and hearing level data for the user; and setting the value of a first parameter designating hearing aid processing to be given to the user, to a value that is the same as the value of a second parameter that has been stored ahead of time in the data storage section and designates hearing aid processing suited to those reference users who gave a second evaluation that matched or was similar to the first evaluation, out of the plurality of reference users.

* * * * *